US006974237B2

(12) United States Patent
Stekelenburg

(10) Patent No.: US 6,974,237 B2
(45) Date of Patent: Dec. 13, 2005

(54) PROTECTIVE STRUCTURE FOR A PORTABLE WORK LIGHT

(76) Inventor: Albert Stekelenburg, 9th Fl., 102 Kuang-Fu S. Rd., Taipei (TW)

( * ) Notice: Subject to any disclaimer, the term of this patent is extended or adjusted under 35 U.S.C. 154(b) by 0 days.

(21) Appl. No.: 10/833,146

(22) Filed: Apr. 28, 2004

(65) Prior Publication Data

US 2005/0243564 A1 Nov. 3, 2005

(51) Int. Cl.[7] ..... F21V 21/00
(52) U.S. Cl. ..... 362/376; 362/400; 362/427; D26/119
(58) Field of Search ..... 362/376–378, 362/400, 427; D26/119

(56) References Cited

U.S. PATENT DOCUMENTS 5,243,507 A * 9/1993 Atkins et al. ..... 362/376
5,455,756 A * 10/1995 Sumer et al. ..... 362/376

* cited by examiner

*Primary Examiner*—Stephen F Husar
(74) *Attorney, Agent, or Firm*—Troxell Law Office, PLLC

(57) ABSTRACT

A protective structure for a portable work light includes a work light located on a rack. The rack consists of a pedestal, a front rack and a holding part. At least one protective grid is located on the rack. The at least one protective grid shields a front of the lighting device.

15 Claims, 3 Drawing Sheets

PROTECTIVE STRUCTURE FOR A PORTABLE WORK LIGHT

FIELD OF THE INVENTION

The present invention relates to a lighting device, more specifically to a portable work light having a protective grid.

BACKGROUND OF THE INVENTION

Conventional portable work lights are generally used in places needing strong light. Since the light is portable, it is subject to unexpected impacts from objects or outside forces. Thus a grid rack B is usually provided on a light body A of the work light in order to protect a transparent front face C of the lighting device or the inner lamp, as shown in FIG. 1. This kind of protection device has disadvantages such as when outside forces strike the grid rack, the impact is directly transferred to the light body. In order to protect the light body and improve a shockproof capability, the grid rack B and the light body A should be spaced apart such that impacts to the grid rack are not directly transferred to the light body to prevent the structure of the light body from being damaged or destroyed.

Other lights, such as traveling lights, fixed jacklights, and work lights are also equipped with grid racks connected to a light body to protect the lighting device.

SUMMARY OF THE INVENTION

The main object and purpose of the present invention is to provide at least one protective grid mounted on a grid rack that is connected to the lighting device. The protective grid and grid rack protect the lighting device from outside forces so that they do not directly impact the lighting device.

The protective structure for the lighting device in this application consists of a light device and a portable rack, the portable rack having a protective grid. The protective grid covers the front of the lighting device to protect the lighting device, or at least the front of the lighting device. The protective grid can be composed of vertical rods, horizontal rods, sloped rods, or a combination thereof.

Another purpose of the present invention is to provide a handle on the portable rack of the work light. The handle is located on an upper part of the portable rack and may be located over a center of the work light for carrying the device.

The protective grid can include either horizontal rods or rods forming a reticulation to provide protection. The protective grid may cover the front, or the front and an upper side of the light device. The area protected by the protective grid may include the front, the upper side and the rear of the light device.

Because the protective grid of this invention is not directly mounted on the lighting device, the main body of the lighting device need not be designed to withstand strikes.

There is a space between the lighting device and the protective grid in the present invention, so that a rotation of the lighting device will not be encumbered.

DETAILED DESCRIPTION OF THE PREFERRED EMBODIMENTS

Figure 1:
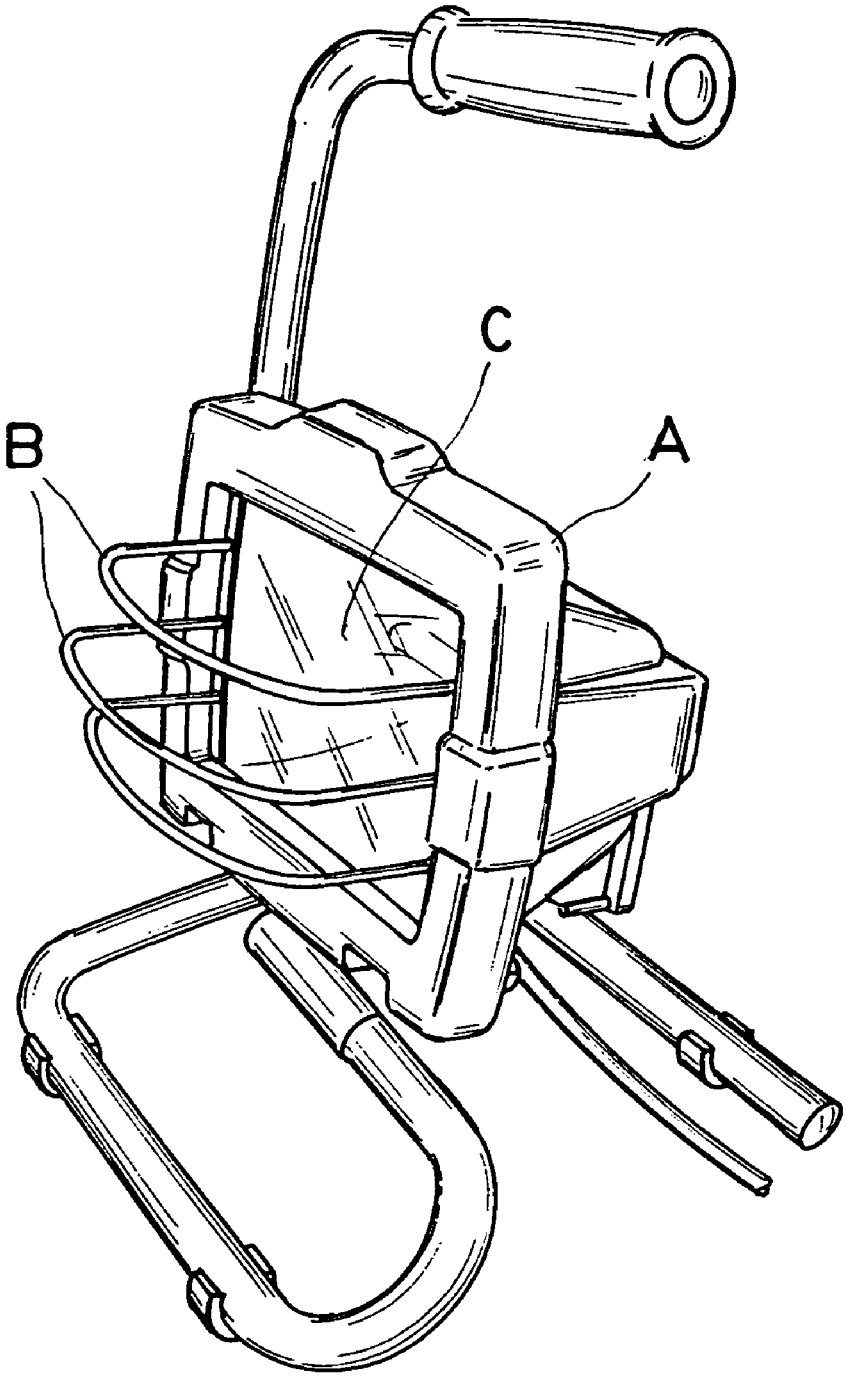
FIG. 1 (PRIOR ART)
FIG. 1 is the perspective view of conventional work light.
Figure 2:
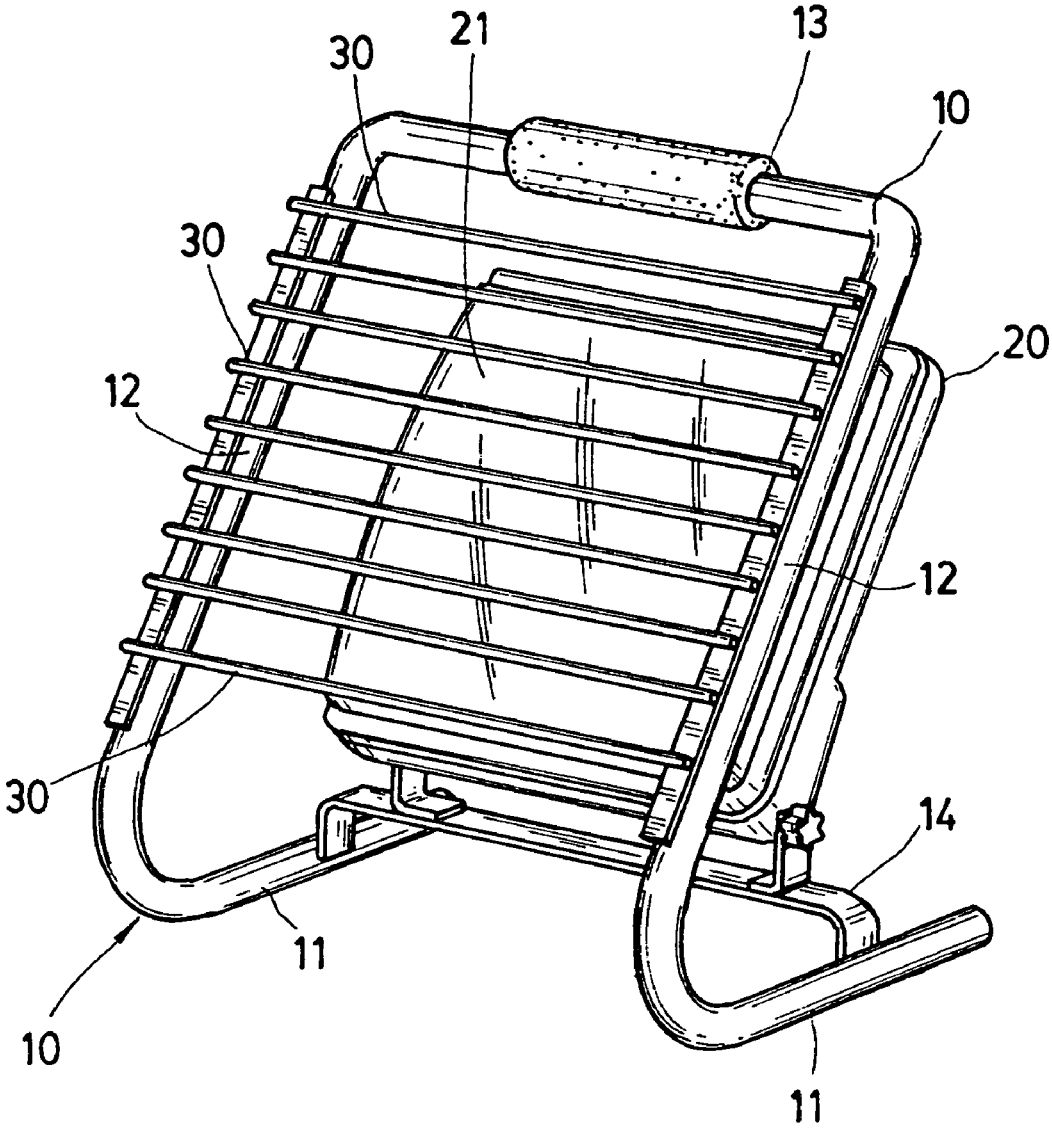
FIG. 2 is the perspective view of the main body and protective grid of the present invention.

As shown in FIG. 2, the protective structure of the present invention consists of a rack 10 and a lighting device 20 pivotally connected to the rack 10. The rack 10 includes at least one protective grid 30 spaced apart from a front face 21 of the lighting device 20.

As shown in FIG. 2, the rack 10 consists of a pedestal 11, a front rack 12 and a holding part or handle 13. The pedestal 11, front rack 12 and holding part 13 can be made by bending a single metal tube or from other materials. The pedestal 11 consists of a two-foot pedestal and a transverse rod 14 is located on the two-foot pedestal to support the lighting device 20.

The front rack 12 consists of a left rod and a right rod extending upwardly from the pedestal 11. The protective grid 30 can be connected to the left rod and the right rod, and is positioned on the rack 10 in a location where the protective grid 30 can shield the front of the lighting device 20. The protective grid 30 can be integrally formed with the rack 10, and may include vertical rods, horizontal rods, sloped rods, or a combination thereof.

The holding part 13 is formed by a rod connecting the tops of the left rod and the right rod. A soft sleeve may be used to surround the holding part 13 for grasping.

The protective grid 30 spans the space between the left rod and the right rod, and includes a plurality of rods extending therebetween to cover the front of the lighting device 20. When outside forces strike the protective grid 30, it is the rack 10, not the lighting device 20, which absorbs the impact imposed on the protective grid 30. Thus, the lighting device 20 is protected by the protective grid 30.

Figure 3:
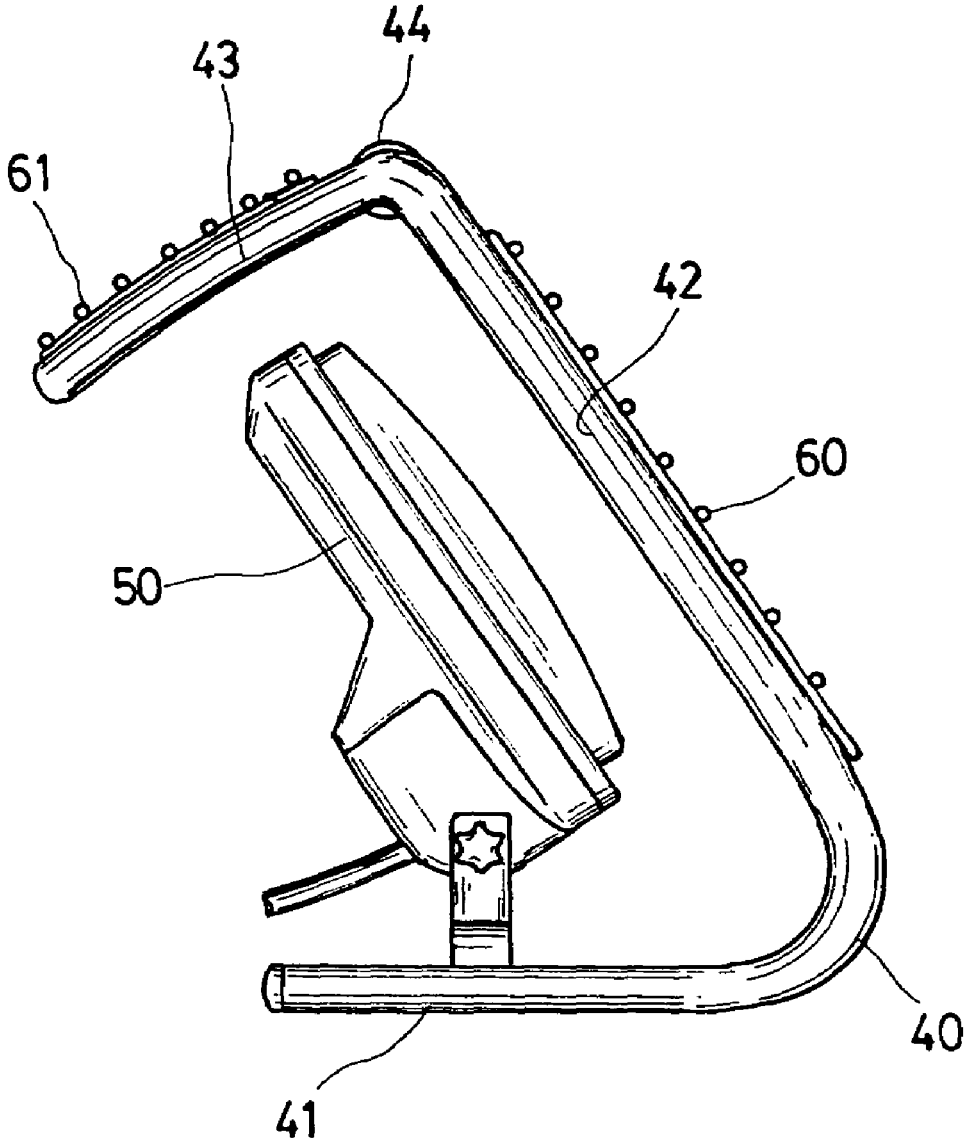
FIG. 3 is the side view of another embodiment of the present invention.

FIG. 3 is the side view of another embodiment of this invention. The structure consists of a rack 40, on which the lighting device 50 is located. The rack 40 consists of a pedestal 41, a front rack 42, a back rack 43, a holding part or handle 44 and protective grids 60, 61. The protective grid 60 is located on the front rack 42, and the protective grid 61 is located on the back rack 43.

The plurality of protective grids 60, 61 provide a larger area of protection for the lighting device 50. The back rack 43 includes a left rod and a right rod, and the protective grid 61 extends between the left and right rods of the back rack 43.

The embodiments disclosed in the specification are only examples. Any minor changes or modification derived from the inventive concept of the present invention will still fall within the scope of the present invention.

What is claimed is:

1. A work light having a protective structure and comprising:

a) a rack having:

i) a pedestal;

ii) a front rack extending from the pedestal, the front rack and the pedestal defining an interior of the rack; and, iii) a protective grid mounted on the front rack; and b) a lighting device mounted on the rack and located in the interior of the rack, the lighting device having a front face facing toward and spaced apart from the protective grid.

2. The work light according to claim 1, further comprising a handle connected to the front rack.

3. The work light according to claim 1, wherein the lighting device is pivotally mounted on the pedestal.

4. The work light according to claim 1, wherein the pedestal comprises a two-footed pedestal.

5. The work light according to claim 1, wherein the front rack includes a left front rod and a right front rod and the protective grid extends between the left and the right front rods.

6. The work light according to claim 5, further comprising a handle located between the left and the right front rods.

7. The work light according to claim 1, wherein the pedestal includes a transverse rod, and the lighting device is pivotally mounted on the transverse rod.

8. The work light according to claim 1, wherein the front rack and the protective grid are integrally formed.

9. The work light according to claim 1, further comprising a back rack connected to the front rack; and, a second protective grid located on the back rack and spaced apart from the lighting device.

10. The work light according to claim 9, wherein the front rack includes a left front rod and a right front rod; the protective grid extends between the left and the right front rods; the back rack includes a left back rod and a right back rod; and the second protective grid extends between the left and the right back rods.

11. The work light according to claim 9, wherein the front rack, the back rack, the protective grid, and the second protective grid are integrally formed.

12. The work light according to claim 9, wherein the protective grid includes a plurality of spaced apart rods.

13. The work light according to claim 12, wherein the second protective grid includes a plurality of spaced apart rods.

14. The work light according to claim 9, wherein the second protective grid includes a plurality of spaced apart rods.

15. The work light according to claim 1, wherein the protective grid includes a plurality of spaced apart rods.

* * * * *